US006477921B1

(12) United States Patent
Picone

(10) Patent No.: US 6,477,921 B1
(45) Date of Patent: Nov. 12, 2002

(54) ANTI-JAMMING COUPLING DEVICE FOR POWERED ADJUSTABLE WRENCH

(76) Inventor: John A. Picone, 2488 Arthur Ct., Oceanside, NY (US) 11572

( * ) Notice: Subject to any disclaimer, the term of this patent is extended or adjusted under 35 U.S.C. 154(b) by 57 days.

(21) Appl. No.: 09/699,365

(22) Filed: Oct. 31, 2000

Related U.S. Application Data

(60) Provisional application No. 60/162,783, filed on Nov. 1, 1999.

(51) Int. Cl.[7] ..... B05B 13/16
(52) U.S. Cl. ..... 81/17; 81/165
(58) Field of Search ..... 81/54, 57.21, 155, 81/165, 170; 269/225, 240, 244

(56) References Cited

U.S. PATENT DOCUMENTS 2,615,682 A * 10/1952 Stone ..... 81/57.21
3,613,983 A * 10/1971 Gage ..... 269/244
4,512,221 A 4/1985 Picone

FOREIGN PATENT DOCUMENTS

FR 927015 * 3/1946 ..... 81/155

* cited by examiner

*Primary Examiner*—James G. Smith
(74) *Attorney, Agent, or Firm*—Liniak, Berenato & White

(57) ABSTRACT

An adjustable jaw end power wrench, in which the adjustable jaw is operated by a worm gear, the worm gear is meshed with the rack of the movable jaw and the worm gear is driven by a reversible electric servomotor. Activation of the servomotor produces linear reciprocating motion of the adjustable jaw. Batteries in a wrench handle provide the power for the electric movement and a control switch controls the function of the wrench. The powered adjustable jaw wrench includes an anti-jamming coupling device provided for un-jamming the wrench when "binding" occurs between the adjustable jaw gear rack and the worm gear.

26 Claims, 13 Drawing Sheets

ANTI-JAMMING COUPLING DEVICE FOR POWERED ADJUSTABLE WRENCH

CROSS-REFERENCE TO RELATED APPLICATION

This Application claims the benefit under 35 U.S.C. 119(e) of U.S. Provisional Application No. 60/162,783 filed Nov. 1, 1999 by John A. Picone.

BACKGROUND OF THE INVENTION

1. Field of the Invention

The present invention relates broadly to power tools and, more particularly, to a powered adjustable wrench having a sliding side jaw.

2. Description of the Prior Art

A powered adjustable jaw wrench having a sliding side jaw and a stationery jaw is known in the prior art. As illustrated in FIG. 1, a fixed jaw 2 is integral with the wrench head 3 and a movable jaw 4 is adjustable relative to the fixed jaw. A worm gear 5 having a pulley 6 is rotated by a belt 7 and a motor pulley 8. The adjustable jaw 4 is provided with an integral gear rack for engagement with the worm gear 5. The worm gear 5 is positioned between the fixed jaw 2 and the pulley 6. A double pole double throw (DPDT) switch 9 is used to control the opening and closing of the movable jaw 4. With an upper handle housing removed, a bottom handle housing 10 houses an electric motor 12 connected to the motor pulley 8 by a shaft 13. Wires 14 and 15 connect the electric motor 12 with the DPDT switch 9 and batteries 16 supply power for the switch and motor. A sub mini jack 18 is used for recharging the batteries 16. The bottom handle housing 10 defines a battery recess 19 and a motor recess 20 containing the motor 12.

However, wrenches of this type suffered certain drawbacks owing to a tendency of the adjustable jaw to jam when "binding" occurs between the adjustable jaw gear rack and the worm gear. One of the reasons of the "binding" to occur is the positioning of the pulley 6 relative to the fixed jaw 2. When utilizing an adjustable wrench for either tightening or loosening, there are forces applied between the worm gear 5 and the moveable jaw 4. The pressure that is applied from the moveable jaw rack, pushes the worm gear 5 away from the stationary jaw creating a binding condition between the worm gear 5 and the moveable jaw rack. Furthermore, when the moveable jaw 4 is fully extended, only part of worm gear leads are engaging the moveable jaw rack, because the moveable jaw rack can not fully extend due to position of the pulley 6 relative to the fixed jaw 2 and the worm gear 5, as described above and illustrated in FIG. 1. Thus, wrench-tends to bind in its fully open position due to lack of full engagement of the worm gear to the moveable jaw rack.

SUMMARY OF THE INVENTION

The present invention is an improvement over the powered adjustable jaw wrench of the prior art disclosed in U.S. Pat. No. 4,512,221 incorporated herein by reference.

It is therefore an object of the present invention to provide for a novel and improved powered adjustable jaw wrench including an anti-jamming coupling device provided for un-jamming the wrench when "binding" occurs between a gear rack of an adjustable jaw and a worm gear.

In accordance with the present invention, the powered adjustable jaw wrench includes a unitary single-piece body member having integral elongated handle portion and a head portion, a stationary jaw defined by the head portion, a movable jaw adjustable relative to the stationary jaw, actuated by a driven mechanism comprising a worm gear rotatably mounted in said head portion of said body member for advancing the movable jaw toward and away from the stationary jaw, and a first rotatable member drivingly coupled to the worm gear, a drive mechanism including a power source, and the anti-jamming coupling device provided for operably connecting the first rotatable member to the worm gear. The anti-jamming coupling device includes a drive member drivingly connected to the first rotatable member and a driven member drivingly connected to the worm gear. The drive member drivingly engages the driven member when the powered adjustable jaw wrench is activated by striking the driven member in order to upset the worm gear when jammed.

In accordance with the first embodiment of the present invention, the first rotatable member of the driven mechanism is a toothed sprocket drivingly coupled to the worm gear, and the drive mechanism comprises a reversible electric motor driving a second sprocket rotating the first sprocket through a toothed belt. A control switch assembly for controlling the electric motor is provided at the handle portion of the wrench body. The wrench body member defines a cavity housing the electric motor and electric batteries supplying an electric power to said electric motor. A handle cover is used to seal the cavity.

In accordance with the second embodiment of the present invention, the wrench body includes a unitary single-piece body member and a pair of opposite handle covers.

In accordance with the third embodiment of the present invention, the drive mechanism includes a chain drive mechanism.

In accordance with the forth embodiment of the present invention, the drive mechanism further includes a speed reduction gearing disposed between the electric motor and the second sprocket.

In accordance with the fifth embodiment of the present invention, the reversible electric motor is disposed in the head portion of the wrench body member.

In accordance with the sixth embodiment of the present invention, the wrench body further include a solar panel (i.e., a battery of solar cells) for recharging the electric batteries.

In accordance with the seventh embodiment of the present invention, the wrench further includes an illumination device mounted to the wrench body and adapted to provide direct illumination a work area in order to facilitate operation in a dark environment.

In accordance with the eighth embodiment of the present invention, the drive mechanism includes a fluid pressure motor as a power source.

In accordance with the ninth embodiment of the present invention, the powered adjustable jaw wrench includes a fluid-pressure turbine for driving the worm gear. The turbine is fluidly connected to a source of pressurized fluid through a fluid flow control valve for controlling direction of rotation of said fluid-pressure turbine. The source of pressurized fluid may be any appropriate external source of pressurized fluid, such as pneumatic pump or compressor.

The tenth embodiment of the present invention is similar to the ninth embodiment wherein the source of pressurized fluid is a pressurized gas cartridge disposed within the handle portion of the wrench body member.

In accordance with the eleventh embodiment of the present invention, the powered adjustable jaw wrench includes a pair of fluid-pressure turbines provided for driving the worm gear. The first turbine is adapted to rotate the worm gear in a clockwise direction, while the second turbine is adapted to rotate the worm gear in a counterclockwise direction.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiments of the present invention will now be described with the reference to accompanying drawings.

Figure 1:
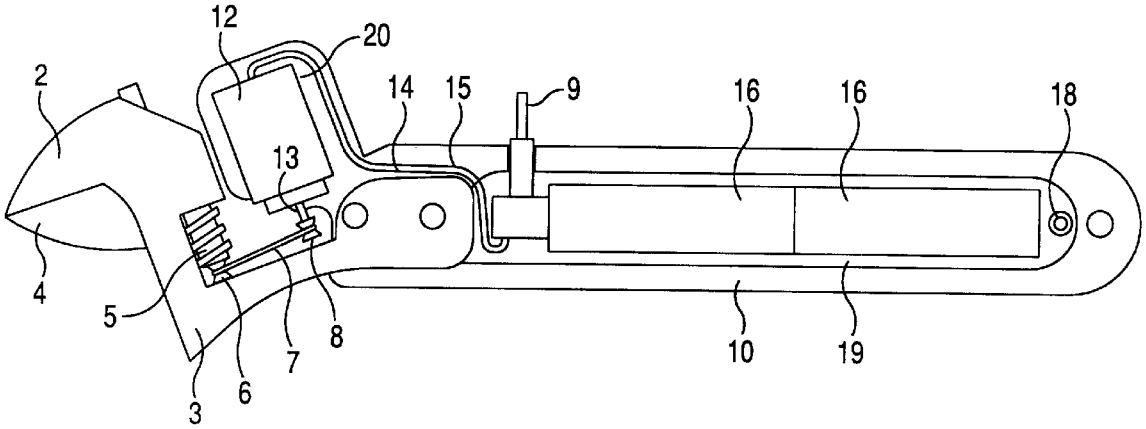
Fig. 1 Prior Art
FIG. 1 is a perspective view showing a powered adjustable jaw wrench of the prior art.
Figure 2:
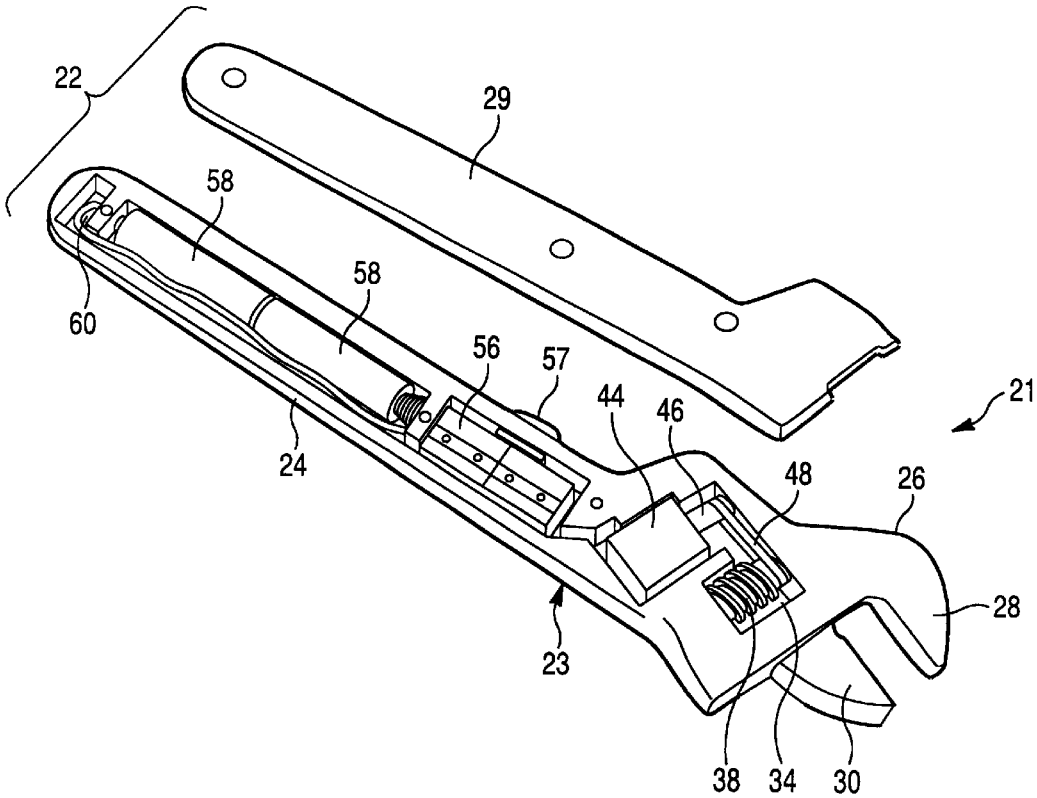
FIG. 2 is a perspective view of a powered adjustable jaw wrench in accordance with the first embodiment of the present invention.
Figure 3:
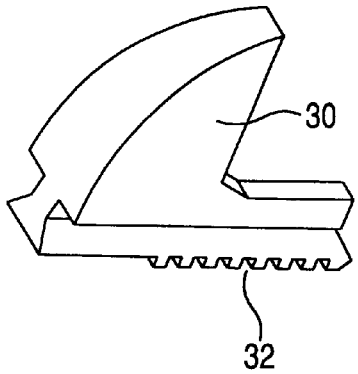
FIG. 3 is a perspective view of a movable jaw.

Referring now to FIG. 2, an improved powered adjustable jaw wrench according to the first embodiment of the present invention illustrated generally at 21 and comprises a wrench body 22 including a wrench body member 23 provided with a stationery jaw 28, and a handle cover 29 removably fastened to the wrench body member 23, and a movable jaw 30 adjustable relative to the stationery jaw 28. The movable jaw 30 is formed integral with a toothed rack 32, as shown in FIG. 3. The wrench body member 23 includes a handle portion 24 and a head portion 26. The stationery jaw 28 is integral to the head portion 26. Preferably, the handle portion 24 and the head portion 26 of the wrench body member 23, illustrated further in detail in FIG. 4, form a unitary single-piece part. It will be appreciated by those skilled in the art that the wrench body member 23 may be made of any appropriate material such as metal (steel, aluminum, etc.) or plastic material. The metal wrench body member 23 may be manufactured, preferably, of stainless steel by forging. However, any other appropriate methods for manufacturing the wrench body member 23 made of metal, such as die-casting or punching from a metal plate, are within the scope of the present invention. The plastic wrench body member is manufactured, preferably, by injection molding. However, any other appropriate methods for manufacturing the wrench body member 23 made of plastic material well known in the prior art, are within the scope of the present invention.

Figure 5:
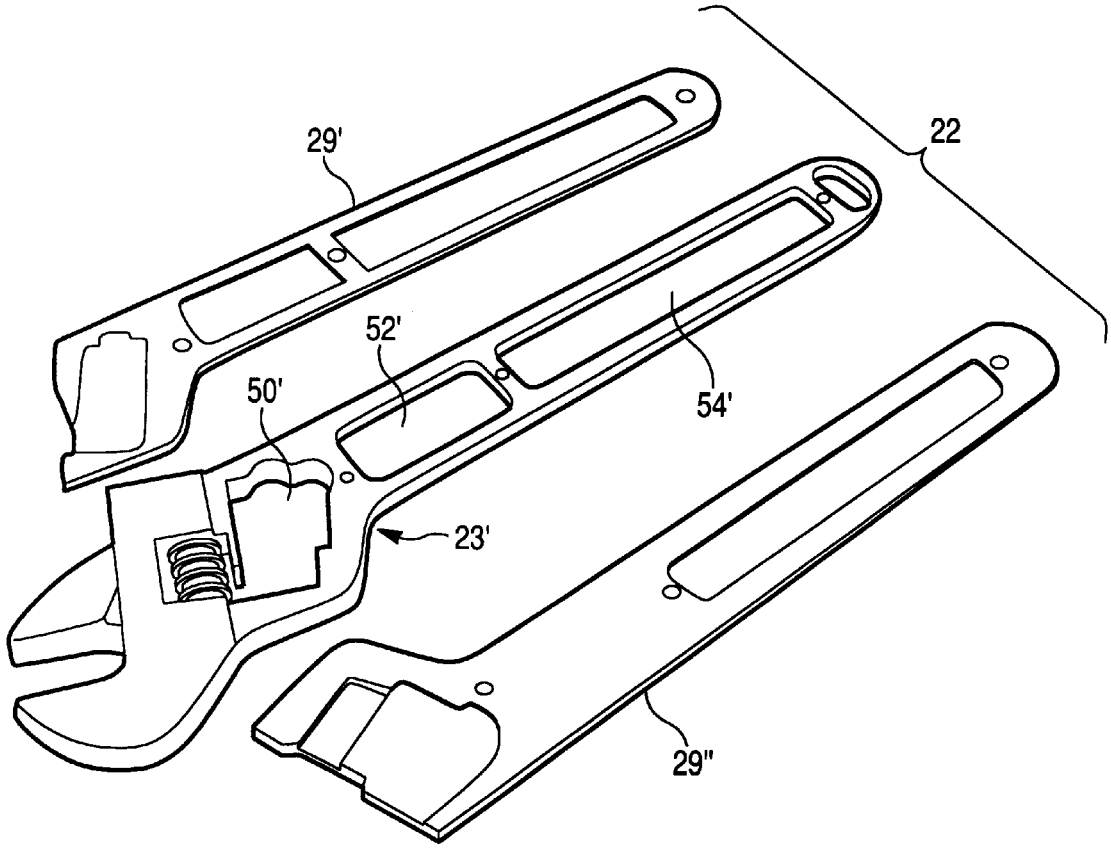
FIG. 5 is an exploded perspective view of the wrench body of the powered adjustable wrench in accordance with the second embodiment of the present invention.

In the modified version according to the second embodiment of the present invention, illustrated in FIG. 5, the wrench body 22 includes a unitary single-piece wrench body member 23 and a pair of opposite handle covers 29' and 29" removably fastened to the wrench body member 23', preferably by bolts or screws.

Figure 6:
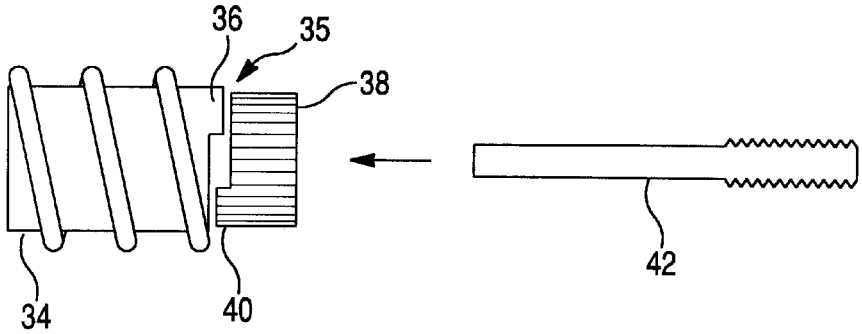
FIG. 6 is a side view of a driven mechanism including an anti-jamming coupling device in accordance with the present invention.

The powered adjustable jaw wrench 21 according to the present invention further includes a driven mechanism comprising a worm gear 34 and a first rotatable member both rotatably mounted in the head portion 26 of the wrench body member 23 coaxially with respect to each other. The worm gear 34 is operably connected to the toothed rack 32 of the movable jaw 30 so that the rotatable movement of the worm gear 34 is transformed into the linear movement of the movable jaw 30. In the first embodiment of the present invention, as illustrated in FIGS. 2 and 6, the first rotatable member is in the form of a first toothed sprocket 38 mounted on a stationary shaft 42 coaxially relative to the worm gear 34. The stationary shaft 42 is mounted in the head portion 26 of the wrench body member 23.

The powered adjustable jaw wrench 21 according to the present invention further includes a drive mechanism having a power source and a second rotatable member. In accordance with the first embodiment of the present invention, illustrated in FIG. 2, the drive mechanism comprises a reversible electric motor 44 mounted in the handle portion 24 and drivingly connected to a second toothed sprocket 46. The reversible electric motor 44 is employed for rotating the worm gear 34 through the second toothed sprocket 46, an endless toothed belt 48 and the first toothed sprocket 38.

In contrast with the prior art powered adjustable wrench, the powered adjustable jaw wrench 21 according to the present invention includes the first toothed sprocket 38 mounted in the head portion 26 between the stationery jaw 28 and the worm gear 34 coaxially thereto. Such an arrangement significantly reduces the possibility of "binding" between the adjustable jaw gear rack and the worm gear, and, thus, the tendency of the powered adjustable jaw wrench 21 to jam.

Figure 7:
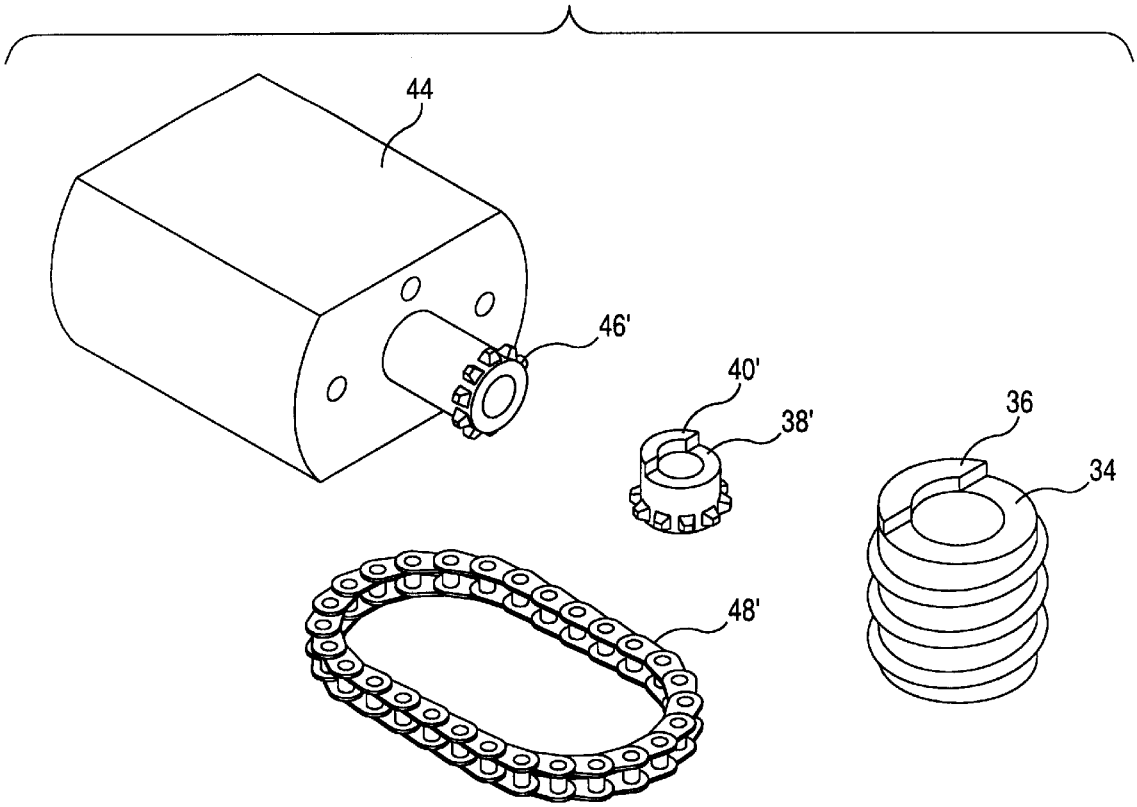
FIG. 7 is an exploded perspective view of a chain drive mechanism in accordance with the third embodiment of the present invention.

In the modified version according to the third embodiment of the present invention, illustrated in FIG. 7, the drive mechanism includes an endless chain 48' interconnecting first and second sprockets 38' and 46' respectively.

It will be appreciated by those skilled in the art that any other type of an endless torque-transmitting element known in the prior art is within the scope of the present invention.

Figure 4:
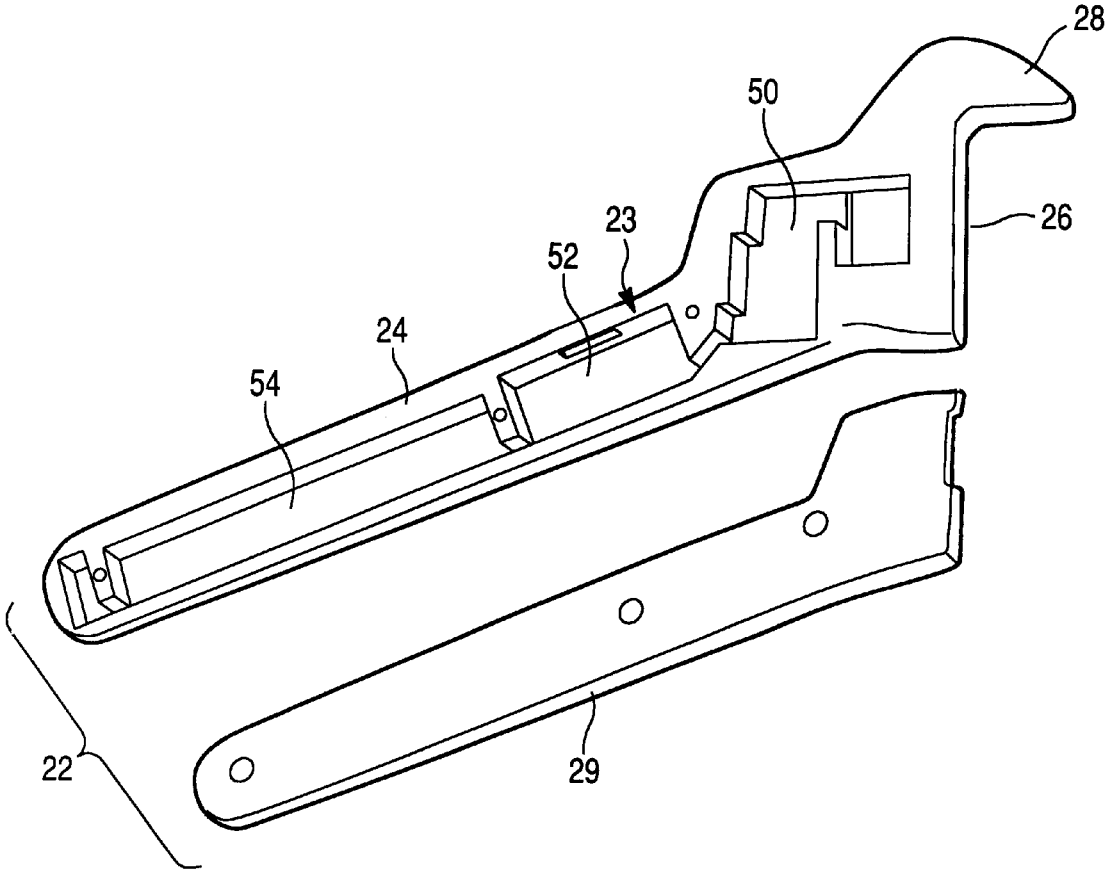
FIG. 4 is an exploded perspective view of a wrench body of the powered adjustable jaw wrench in accordance with the first embodiment of the present invention.

As illustrated in FIG. 2, the electric motor 44 is electrically connected to a control switch assembly 56 including a switch actuator 57, controlling the motor 44 and at least one electric battery 58 supplying electric power to the motor 44 and the control switch assembly 56. Preferably, two batteries 58 are provided. The batteries 58 may be rechargeable. In this case, a sub mini jack 60 is used for recharging the batteries 58. The electric motor 44, the control switch assembly 56 and the electric battery 58 are disposed in compartments 50, 52 and 54 respectively, formed in the handle portion 24 of the wrench body member 23, as illustrated in FIG. 4. The handle cover 29 is adapted to seal the compartments 50, 52 and 54.

In accordance with the second embodiment of the present invention, illustrated in FIG. 5, the wrench body member 23' is provided with through openings 50', 52' and 54' housing the electric motor 44, the control switch assembly 56 and the electric battery 58, respectively.

Figure 8:
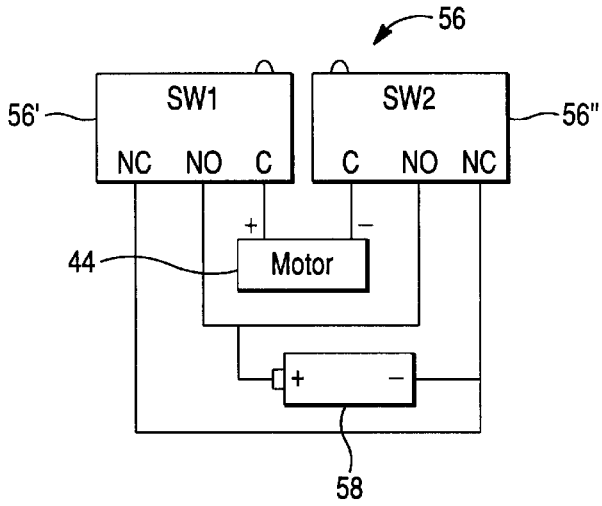
FIG. 8 is a schematic diagram of an electric circuitry for the powered adjustable jaw wrench in accordance with the first embodiment of the present invention.
Figure 9A:
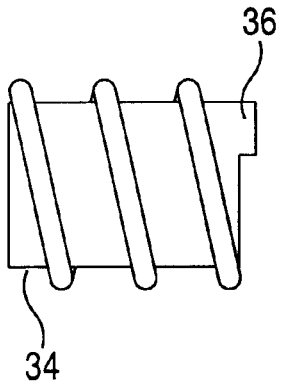
FIG. 9A is a side view of a worm gear in accordance with the present invention.
Figure 9B:
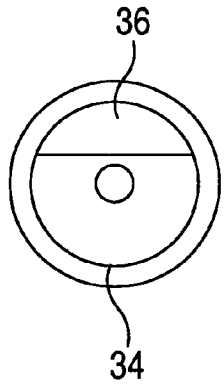
FIG. 9B is a front view of a worm gear in accordance with the present invention.
Figure 10A:
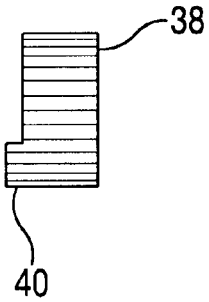
FIG. 10A is a side view of a first sprocket in accordance with the present invention.
Figure 10B:
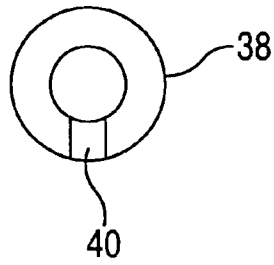
FIG. 10B is a front view of a first sprocket in accordance with the present invention.

It will be appreciated that any appropriate type of electrical switches known in the prior art may be utilized in the present invention, such as a double pole double throw (DPDT) switch. Preferably, the control switch assembly 56 includes a pair of single pole double throw (SPDT) switches 56' and 56" and the switch actuator 57, as shown in FIG. 8.

The powered adjustable jaw wrench 21 according to the present invention further comprises an anti-jamming coupling device 35 designed for un-jamming the wrench when "binding" occurs between the adjustable jaw gear rack and the worm gear. The anti-jamming coupling device 35, as illustrated in detail in FIGS. 6, 9A, 9B, 10A and 10B, includes a drive member in the form of a drive key 40 axially protruding from the first sprocket 38 and a driven member in the form of a driven key 36 axially protruding from the worm gear 34, wherein the drive key 40 is adapted to positively engage the driven key 36 for drivingly connecting the first sprocket 38 to the worm gear 34. Prior to actuation of the electric motor 44, the drive key 40 is circumferentially spaced from the driven key 36. When the control switch assembly 56 actuates the electric motor 44, the drive key 40 rotates toward the driven key 36 and engages it. The engagement of the driven key 36 by the drive key 40 is accompanied by the striking (or hammering) action that upsets the jammed wrench 21 when "binding" occurs between the gear rack 32 of the movable jaw 30 and the worm gear 34.

Preferably, the first sprocket 38 forms a unitary single-piece part with the drive key 40. Similarly, the worm gear 34 forms a unitary single-piece part with the driven key 36.

The anti-jamming coupling device is also illustrated in connection with the third embodiment of the present invention. As shown in FIG. 7, the first sprocket 38' is provided with an integral drive key 40' axially protruding therefrom and the worm gear 34 is provided with the integral drive key 36 axially protruding therefrom.

Figure 11:
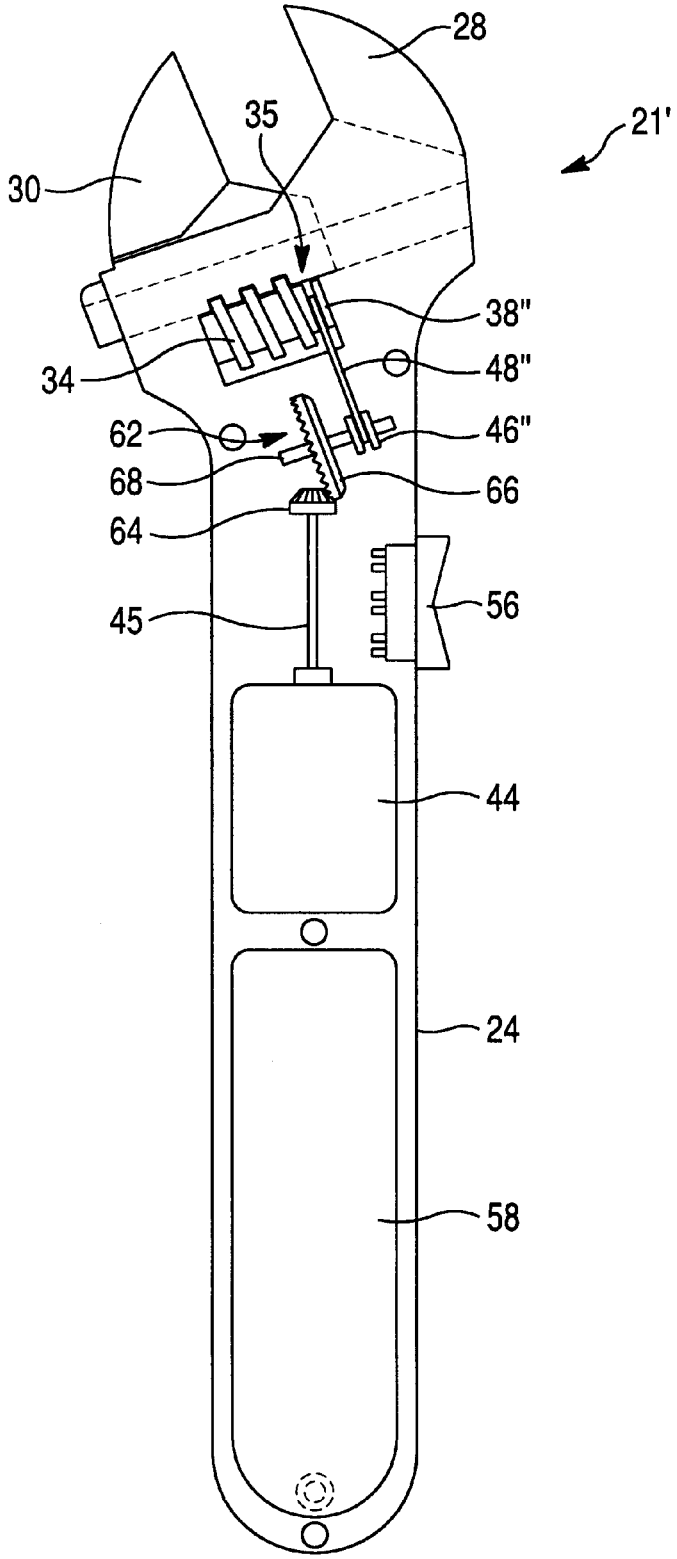
FIG. 11 is a side view of the powered adjustable jaw wrench with removed handle cover in accordance with the fourth embodiment of the present invention.

In the forth embodiment of the present invention, illustrated in FIG. 11, the power wrench 21' includes a gear reduction mechanism 62 including a pinion gear 64 fixed to a shaft 45 of the electric motor 44, and a gear 66 fixed to a shaft 68 rotatably supporting the second rotatable member in the form of a second pulley 46". The second pulley 46" is adapted to transfer torque to the first rotatable member in the form of a first pulley 38" via an endless belt 48". The above described anti-jamming coupling device 35 is provided between the first pulley 38" and the worm gear 34, including the drive key (not shown) axially extending from the first pulley 38" adapted to positively engage the driven key (not shown) axially extending from the worm gear 34.

Figure 12:
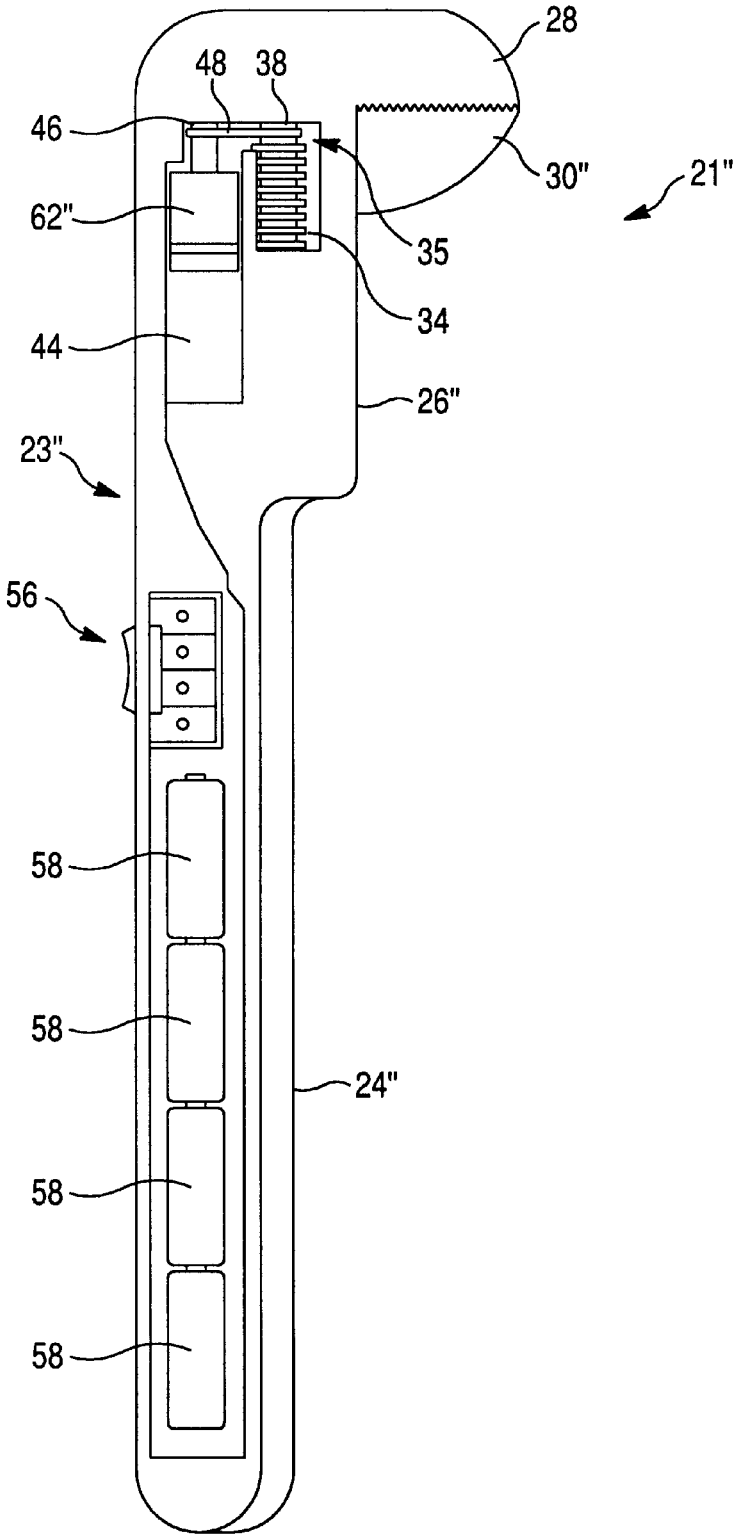
FIG. 12 is a side view of the powered adjustable jaw wrench with removed handle cover in accordance with the fifth embodiment of the present invention.

In the fifth embodiment of the present invention, illustrated in FIG. 12, powered adjustable jaw pipe-wrench 21" comprising a unitary single-piece wrench body member 23" provided with a stationery jaw 28", and a movable jaw 30" adjustable relative to the stationery jaw 28". The wrench body member 23" includes a handle portion 24" and a head portion 26". The stationery jaw 28" is integral to the head portion 26". A drive mechanism comprises the reversible electric motor 44 mounted in the head portion 26" and drivingly connected to a second toothed sprocket 46 through a speed reduction gearing 62". The reversible electric motor 44 is employed for rotating the worm gear 34 through the second toothed sprocket 46, the endless toothed belt 48 and the first toothed sprocket 38. The above described anti-jamming coupling device 35 is provided between the first sprocket 38 and the worm gear 34, including the drive key (not shown) axially extending from the first sprocket 38 adapted to positively engage the driven key (not shown) axially extending from the worm gear 34.

Figure 13:
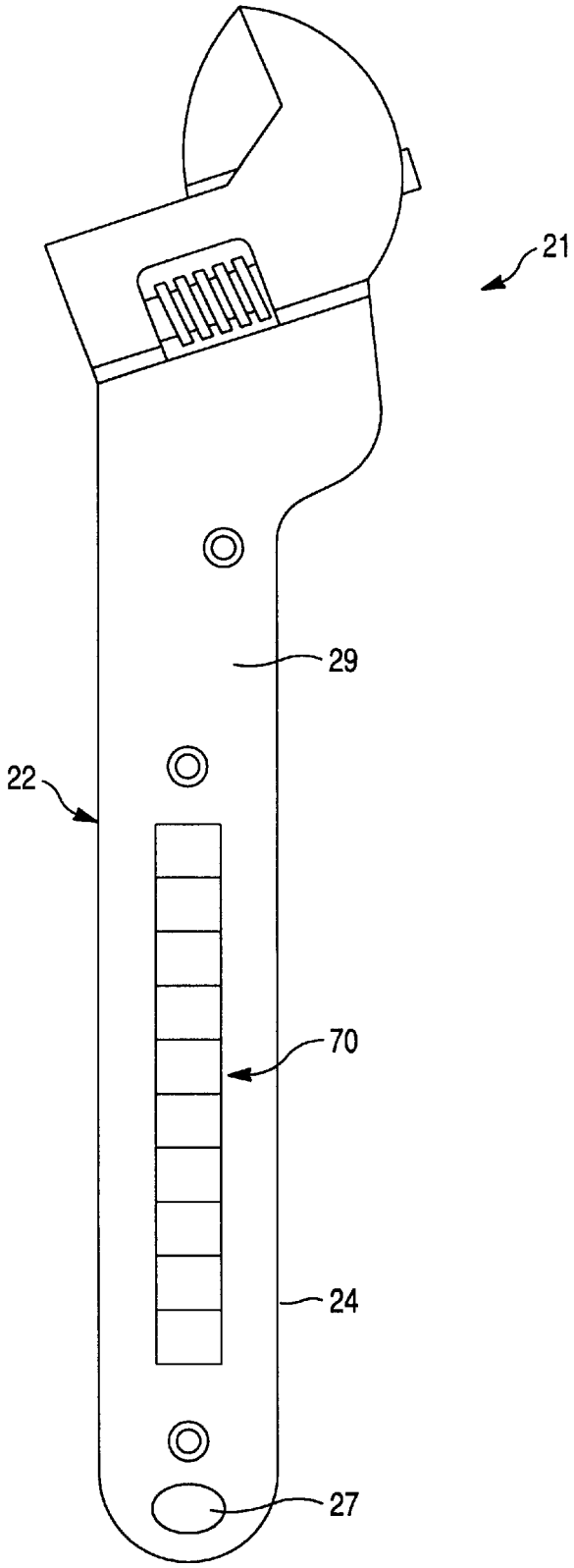
FIG. 13 is a side view of the powered adjustable jaw wrench in accordance with the sixth embodiment of the present invention.

In the sixth embodiment of the present invention, illustrated in FIG. 13, the power wrench 21 is provided with a battery of solar cells, i.e. solar panel 70, employed to recharge electric batteries 58. The solar panel 70 is mounted to the handle portion of the wrench body 22, preferably to the handle cover 29.

As shown in FIG. 13, the power wrench 21 may be provided with a through-hole 27 disposed at a distal end of the handle portion 24 of the wrench body 22 for tethering and/or hanging the power wrench 21.

Figure 14:
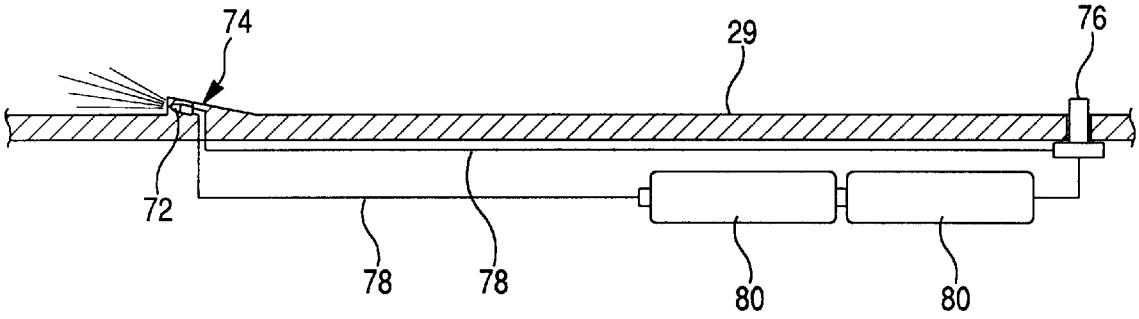
FIG. 14 is a cross-sectional view of a handle cover in accordance with the seventh embodiment of the present invention.

In the seventh embodiment of the present invention, illustrated in FIG. 14, the power wrench 21 is provided with an illumination device mounted to the wrench body 22 and adapted to provide direct illumination of a work area in order to facilitate operation in a dark environment. The illumination device comprises a lamp bulb 72 disposed in a raised lamp housing 74 formed in the handle cover 29. A switch 76 is utilized to operate the lamp bulb 72. Electric wires 78 connect the lamp bulb 72 with the switch 76 and electric batteries 80. Alternatively, the electric batteries 58 supplying electric power to the motor 44, may be used to supply power to the lamp bulb 72.

Figure 15:
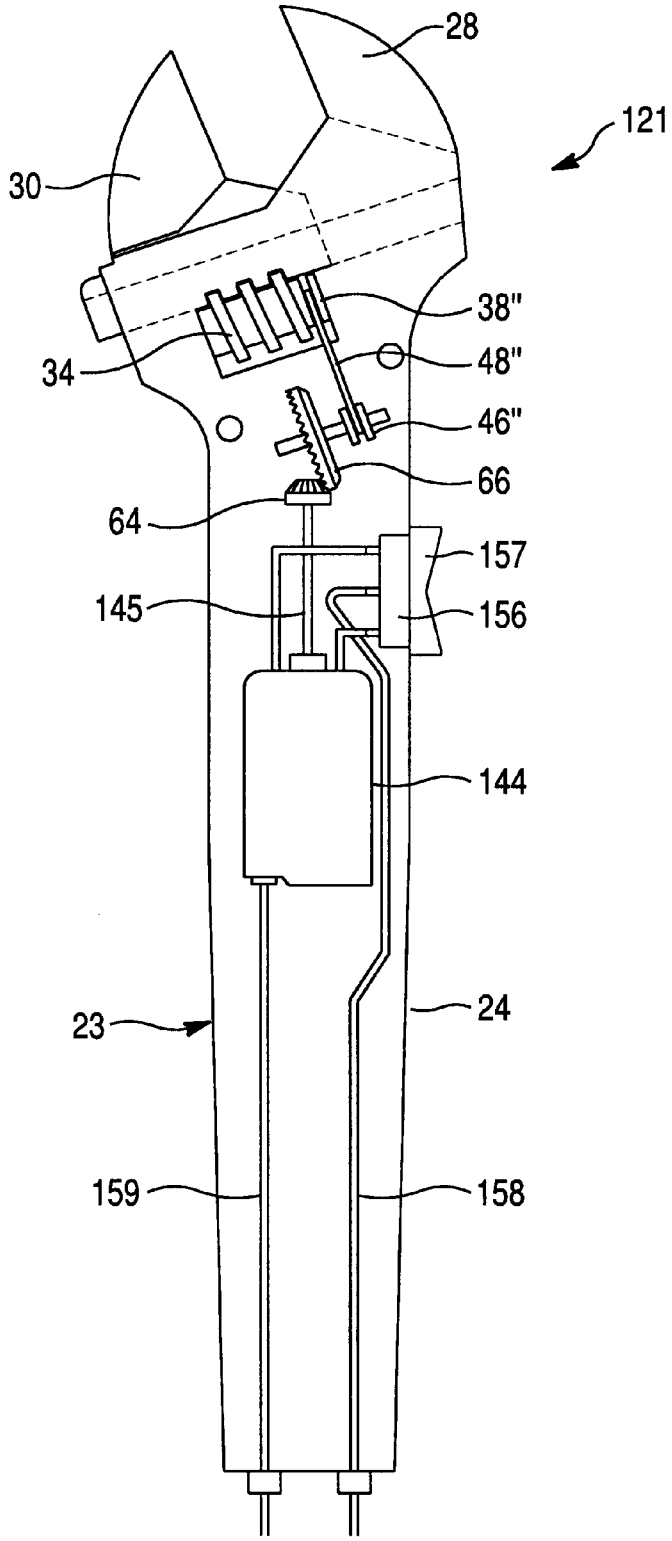
FIG. 15 is a side view of the powered adjustable jaw wrench with removed handle cover in accordance with the eighth embodiment of the present invention.

The eighth embodiment of the present invention, illustrated in FIG. 15, discloses a powered adjustable jaw wrench 121 similar to the power wrench 21' in accordance with the forth embodiment of the present invention illustrated in FIG. 10, wherein instead of the electric motor 44 a fluid-pressure motor 144, such as pneumatic or hydraulic motor, is employed. The fluid-pressure motor 144 is fluidly connected to an external source of pressurized fluid (not shown) via inlet tubing 158 and return tubing 159. A fluid flow control valve 156 including a valve actuator 157, is provided to control direction of rotation of the motor 144.

Alternatively, a pressurized gas cartridge, such as $CO_2$ cartridge, (not shown), or a rechargeable pressurized gas storage tank (not shown), mounted in the handle portion 24, may be utilized. Gas under pressure may be charged into the storage tank through the gas fitting by external sources of the compressed gas, such as a hand pump, compressor, charging tanks or cartridges.

Figure 16:
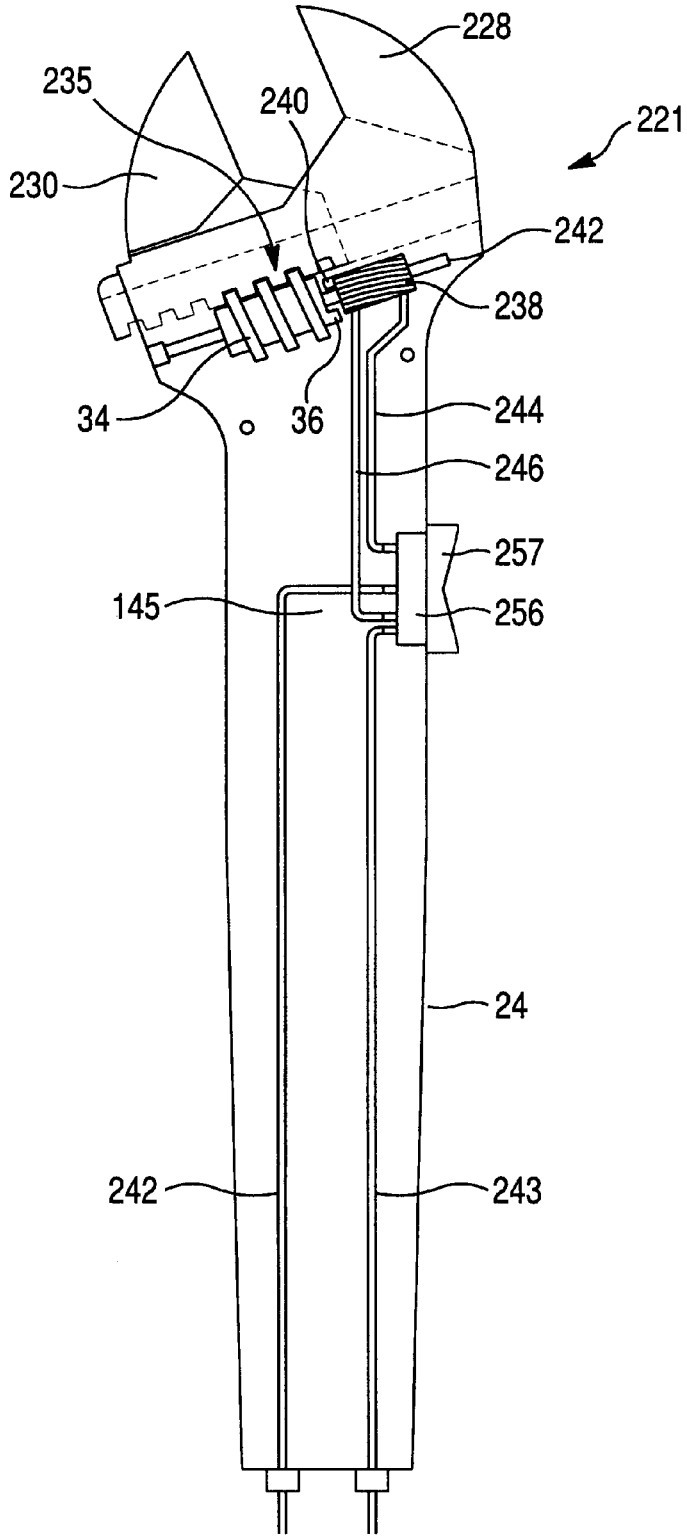
FIG. 16 is a side view of the powered adjustable jaw wrench with removed handle cover in accordance with the ninth embodiment of the present invention.

In the ninth embodiment of the present invention, illustrated in FIG. 16, a power wrench 221 includes a fluid-pressure turbine 238 as the first rotatable member. The fluid-pressure turbine 238 is rotatably mounted to a shaft 242. An anti-jamming coupling device 235 is provided between the turbine 238 and the worm gear 34, including a drive key 240 integral with the turbine 238 and the driven key 36 integral with the worm gear 34. The drive key 240 positively engages the driven key 36 when the turbine 238 is activated.

The fluid-pressure turbine 238 is fluidly connected to an external source of pressurized fluid (not shown), such as pressurized gas (e.g. air or carbon dioxide), via fluid tubing 242, 243, 244 and 246. A fluid flow control valve assembly 256 including a valve actuator 257, is provided to control direction of rotation of the turbine 238.

Figure 17:
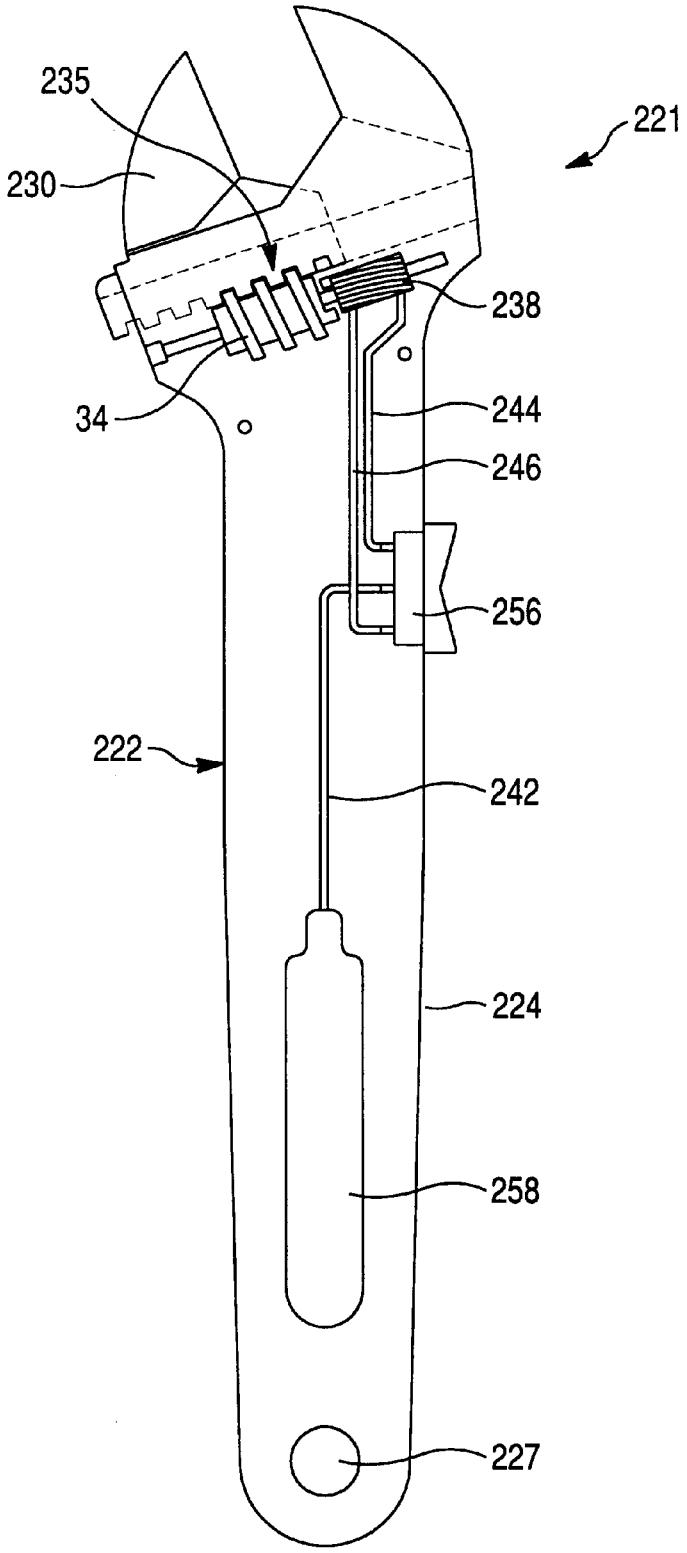
FIG. 17 is a side view of the powered adjustable jaw wrench with removed handle cover in accordance with the tenth embodiment of the present invention.

Alternatively, in accordance with the tenth embodiment of the present invention, as illustrated in FIG. 17, a pressurized fluid cartridge, such as $CO_2$ cartridge, 258 mounted in the handle portion 224, is utilized as a source of pressurized fluid. As shown in FIG. 17, the power wrench 221 may be provided with a through-hole 227 disposed at a distal end of the handle portion 224 of the wrench body 222 for tethering and/or hanging the power wrench 21.

Figure 18:
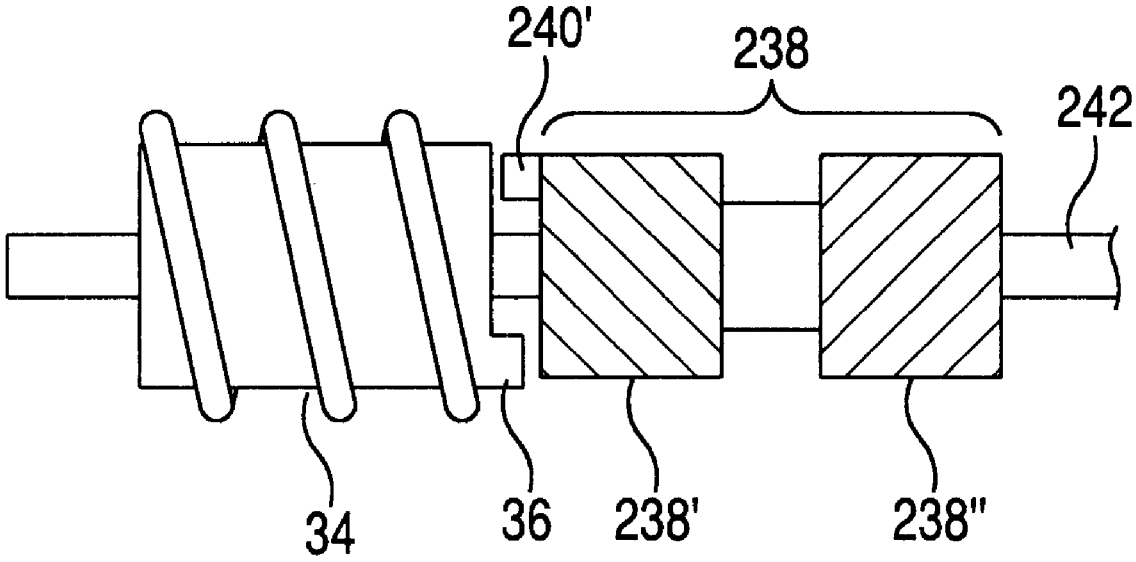
FIG. 18 is the driven mechanism of the powered adjustable jaw wrench in accordance with the eleventh embodiment of the present invention.

In the eleventh embodiment of the present invention, illustrated in FIG. 18, the fluid-pressure turbine 238 consists of two interconnected turbines: a first turbine 238' adapted for rotating the worm gear 34 in one direction, and a second turbine 238" adapted for rotating the worm gear 34 in opposite direction.

Therefore, the powered adjustable jaw wrench in accordance with the present invention includes a novel arrangement of the w anti-jamming coupling device provided for un-jamming the wrench when "binding" occurs between the adjustable jaw gear rack and the worm gear.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A powered adjustable jaw wrench with anti-jamming device, said power jaw wrench comprising:

a wrench body including a wrench body member having a handle portion and a head portion, said head portion defining a stationary jaw;

a movable jaw reciprocally mounted to said head portion of said body member in alignment with said stationary jaw, said movable jaw including a gear rack portion;

a driven mechanism mounted to said head portion of said body member, said driven mechanism being operably connected to said movable jaw and causing movement of said movable jaw relative to said stationary jaw, said driven mechanism including:

a worm gear rotatably mounted in said head portion of said body member, said worm gear engaging said gear rack portion of said movable jaw; and a first rotatable member operably connected to said worm gear;

a drive mechanism including a power source mounted in said body member for driving said driven mechanism; and an anti-jamming coupling device provided for operably connecting said first rotatable member to said worm gear and for upsetting said worm gear if jammed by striking action when said powered adjustable jaw wrench is activated.

2. The powered adjustable jaw wrench as defined in claim 1, wherein said anti-jamming coupling device including a drive-member drivingly connected to said first rotatable member and a driven member drivingly connected to said worm gear, wherein said drive member is provided for drivingly engaging said driven member when said powered adjustable jaw wrench is activated by striking said driven member in order to upset said worm gear when jammed.

3. The powered adjustable jaw wrench as defined in claim 2, wherein said drive member of said anti-jamming coupling device includes a drive key axially protruding from said first rotatable member and said driven member of said anti-jamming coupling device includes a driven key axially protruding from said worm gear.

4. The powered adjustable jaw wrench as defined in claim 3, wherein said drive key forms a unitary single-piece part with said first rotatable member and said driven key forms a unitary single-piece part with said worm gear.

5. The powered adjustable jaw wrench as defined in claim 1, wherein said drive mechanism further includes a second rotatable member rotatably mounted in said wrench body and an endless drive member extending between said first and said second rotatable members to transfer torque from said first rotatable member to said second rotatable member, and wherein said power source is drivingly connected said second rotatable member.

6. The powered adjustable jaw wrench as defined in claim 5, wherein said first rotatable member is disposed between said stationary jaw and said worm gear.

7. The powered adjustable jaw wrench as defined in claim 5, further including a speed reduction gearing disposed between said power source and said second rotatable member.

8. The powered adjustable jaw wrench as defined in claim 5, wherein said endless drive member is a toothed belt and said first and second rotatable member are sprockets engaging said toothed belt.

9. The powered adjustable jaw wrench as defined in claim 5, wherein said endless drive member is an endless chain and said first and second rotatable members are sprockets engaging said chain.

10. The powered adjustable jaw wrench as defined in claim 5, wherein said power source is a reversible electric motor.

11. The powered adjustable jaw wrench as defined in claim 10, wherein said electric motor is mounted in said handle portion of said wrench body member.

12. The powered adjustable jaw wrench as defined in claim 10, wherein said electric motor is mounted in said head portion of said wrench body member.

13. The powered adjustable jaw wrench as defined in claim 10, further including a control switch assembly disposed in said handle portion of said wrench body member and electrically connected to said electric motor for controlling movement of said movable jaw.

14. The powered adjustable jaw wrench as defined in claim 13, wherein said control switch assembly includes two single pole double throw switches and a switch actuator.

15. The powered adjustable jaw wrench as defined in claim 10, further including at least one electric battery connected to said electric motor and said control switch assembly for supplying an electric power to said electric motor, said electric battery disposed in said handle portion of said wrench body member.

16. The powered adjustable jaw wrench as defined in claim 15, wherein said handle portion of said wrench body includes a battery of solar cells provided for recharging said at least one electric battery.

17. The powered adjustable jaw wrench as defined in claim 5, wherein said power source is a fluid-pressure motor.

18. The powered adjustable jaw wrench as defined in claim 1, wherein said handle portion and said head portion of said wrench body member forming a unitary single-piece part.

19. The powered adjustable jaw wrench as defined in claim 18, wherein said handle portion of said wrench body member defines an open cavity for housing said drive mechanism, said wrench body further including at least one handle cover removably secured to said handle portion of said wrench body member for closing said cavity.

20. The powered adjustable jaw wrench as defined in claim 18, wherein said wrench body member is made of plastic material by an injection molding process.

21. The powered adjustable jaw wrench as defined in claim 18, wherein said wrench body member is made of stainless steel by forging.

22. The powered adjustable jaw wrench as defined in claim 1, wherein said first rotable member is a fluid-pressure turbine fluidly connected to a source of pressurized fluid through a fluid flow control valve for controlling direction of rotation of said fluid-pressure turbine.

23. The powered adjustable jaw wrench as defined in claim 22, wherein said source of pressurized fluid is a pressurized gas cartridge mounted in said handle portion of said wrench body member.

24. The powered adjustable jaw wrench as defined in claim 23, wherein said gas is $CO_2$.

25. The powered adjustable jaw wrench as defined in claim 22, wherein said source of pressurized fluid is a rechargeable pressurized gas storage tank mounted in said handle portion of said wrench body member.

26. The powered adjustable jaw wrench as defined in claim 1, further including a through-hole disposed at a distal end of said handle portion of said wrench body provided for hanging thereof.

* * * * *